US006638024B1

(12) United States Patent
Hancock

(10) Patent No.: US 6,638,024 B1
(45) Date of Patent: Oct. 28, 2003

(54) HYDRAULIC AIR COMPRESSOR SYSTEM—EMPLOYING A BODY OF FLUID TO PROVIDE COMPRESSION

(76) Inventor: Bruce Jay Hancock, 1533 W. Roma Ave., Phoenix, AZ (US) 85015

( * ) Notice: Subject to any disclaimer, the term of this patent is extended or adjusted under 35 U.S.C. 154(b) by 0 days.

(21) Appl. No.: 09/975,866

(22) Filed: Oct. 12, 2001

Related U.S. Application Data

(60) Provisional application No. 60/239,755, filed on Oct. 12, 2000.

(51) Int. Cl.[7] ..... F04F 11/00

(52) U.S. Cl. ..... 417/65; 417/53; 417/87; 417/91; 417/108; 137/236.1

(58) Field of Search ..... 417/53, 87, 90, 417/91, 108, 65; 137/236.1

(56) References Cited

U.S. PATENT DOCUMENTS 3,664,388 A * 5/1972 Frankel ..... 141/284
3,763,652 A * 10/1973 Rinta ..... 405/53
5,961,047 A * 10/1999 Kleinberger ..... 239/124
6,272,839 B1 * 8/2001 Karl ..... 60/783

FOREIGN PATENT DOCUMENTS

JP 2002021800 A * 1/2002 ..... F04F/1/00

* cited by examiner

*Primary Examiner*—Tae Jun Kim
*Assistant Examiner*—Emmanuel Sayoc
(74) *Attorney, Agent, or Firm*—Robert A. Parsons; Michael W. Goltry; Parsons & Goltry

(57) ABSTRACT

A gas compression system including a body of fluid and a down pipe. A first end of the down pipe is positioned to receive a fluid from a source above a surface of the body of fluid and a second end is positioned at a lower level of the body of fluid. A gas inlet is coupled to the down pipe, above the surface of the body of fluid for mixing a gas to be compressed with the fluid from the source to form a mixture. A chamber is positioned at the lower level of the body of fluid and coupled to the second end of the down pipe for receiving the mixture and collecting a compressed gas therefrom. A conduit is coupled to the chamber for transferring the compressed gas therefrom.

20 Claims, 4 Drawing Sheets

HYDRAULIC AIR COMPRESSOR SYSTEM— EMPLOYING A BODY OF FLUID TO PROVIDE COMPRESSION

CROSS-REFERENCE TO RELATED APPLICATION

This application claims the benefit of U.S. Provisional Application No. 60/239,755 filed Oct. 12, 2000.

FIELD OF THE INVENTION

This invention relates to energy conversion.

More particularly, the present invention relates to generating compressed gasses.

In a further and more specific aspect, the instant invention concerns power generation from compressed gasses.

BACKGROUND OF THE INVENTION

Hydraulic air compressors have been known and used for many years. Conventional compressors include an intake head where water and air are mingled, followed by a gravity-fall tube (down-pipe) in which air is intimately mixed with water and is compressed as the water pressure increases during the fall down the tube. The gravity-fall tube terminates in a separating chamber in which air bubbles rise to the surface of the water and are collected at the top portion of the chamber. The water exits the chamber and is discharged in a standing tube (up-pipe) that generally extends vertically from a lower portion of the chamber. The air collected in the upper part of the chamber is at a pressure substantially equal to the water head maintained by the height of water in the standing tube. The water is discharged from the end of the standing tube that is positioned at a suitable height below the intake head to provide a hydraulic head.

While conventional hydraulic compressors have been proven to work, there are many problems. The first problem is achieving a hydraulic head. This is typically overcome by limiting the location of compressors to dams and locks. The intake head is at the top of the dam, and the water is exhausted at the bottom of the dam. While the hydraulic head has been achieved, a gravity/fall tube, a chamber and a standing pipe must still be formed. This is typically accomplished by digging a passage downward from the level of the top of the dam to a depth well below the bottom of the dam. A chamber is created at the terminus of the downward passage and a standing tube is formed by digging a passage from the chamber upward to the base of the dam. The compression of the air is determined by the height of the standing tube. Formation of these elements is extremely expensive, as formation of the passages is time consuming and costly. Generally in the past, locations with partial passages, such as old mine shafts, have been used to reduce costs. These locations, however, are limited and only slightly reduce the cost. Therefore, these devices have been limited to small applications such as at dams and locks to produce compressed air for pneumatic operation of airlifts, gates, valves, and rubber gate seals.

Thus, while hydraulic air compressors have been known and used for many decades, due to the high construction costs and location limitations they have never been used extensively and are not used for power generation.

It would be highly advantageous, therefore, to remedy the foregoing and other deficiencies inherent in the prior art.

Accordingly, it is an object of the present invention to provide a new and improved hydraulic air compressor.

Another object of the invention is to provide a hydraulic air compressor that can be employed adjacent substantially any body of water.

And another object of the invention is to provide a hydraulic air compressor that can be employed for power generation.

Still another object of the present invention is to provide a hydraulic air compressor which is extremely cost effective.

SUMMARY OF THE INVENTION

Briefly, to achieve the desired objects of the present invention in accordance with a preferred embodiment thereof, provided is a gas compression system including a body of fluid and a down pipe. A first end of the down pipe is positioned to receive a fluid from a source above a surface of the body of fluid and a second end is positioned at a lower level of the body of fluid. A gas inlet is coupled to the down pipe above the surface of the body of fluid for mixing a gas to be compressed with the fluid from the source to form a mixture. A chamber is positioned at the lower level of the body of fluid and coupled to the second end of the down pipe for receiving the mixture and collecting a compressed gas therefrom. A conduit is coupled to the chamber for transferring the compressed gas therefrom.

Also provided is a method of compressing a gas.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
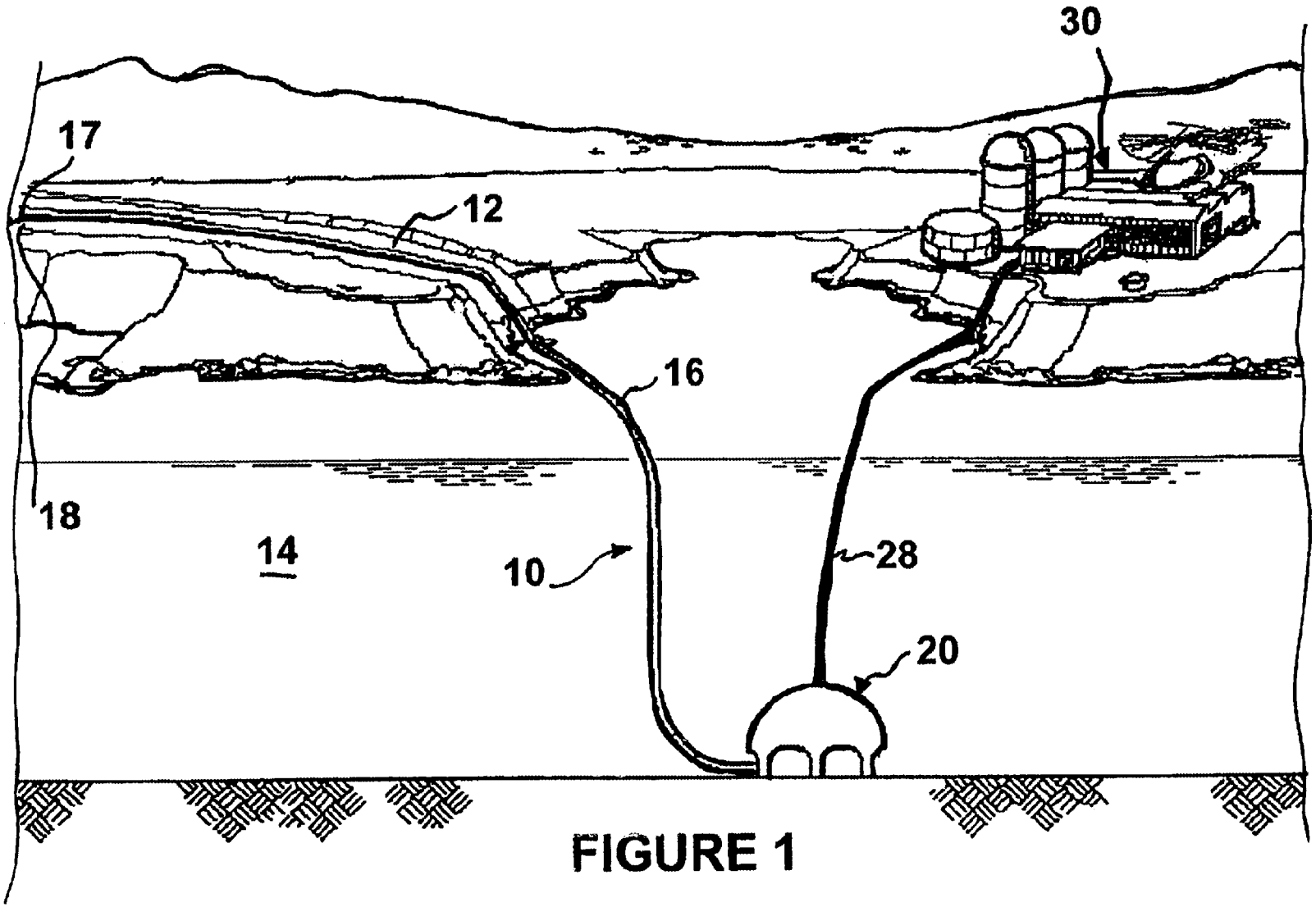
FIG. 1 is a perspective view of the hydraulic air compressor system according to the present invention.

Turning now to the drawings in which like reference characters indicate corresponding elements throughout the several views, attention is first directed to FIG. 1 which illustrates a hydraulic air compressor system generally designated 10. System 10 includes a water source such as a river 12, and a body of water, such as a lake or ocean 14. A down-pipe 16 is positioned with an intake head 17 at a point 18 a distance up river 12 to achieve a sufficient hydraulic head. Generally, rivers increase in height above sea level with increased distance from the ocean. This is also true of rivers flowing-into other bodies of water such as lakes. Pipe 16 terminates at the bottom of ocean 14 and empties into a chamber 20.

Figure 2:
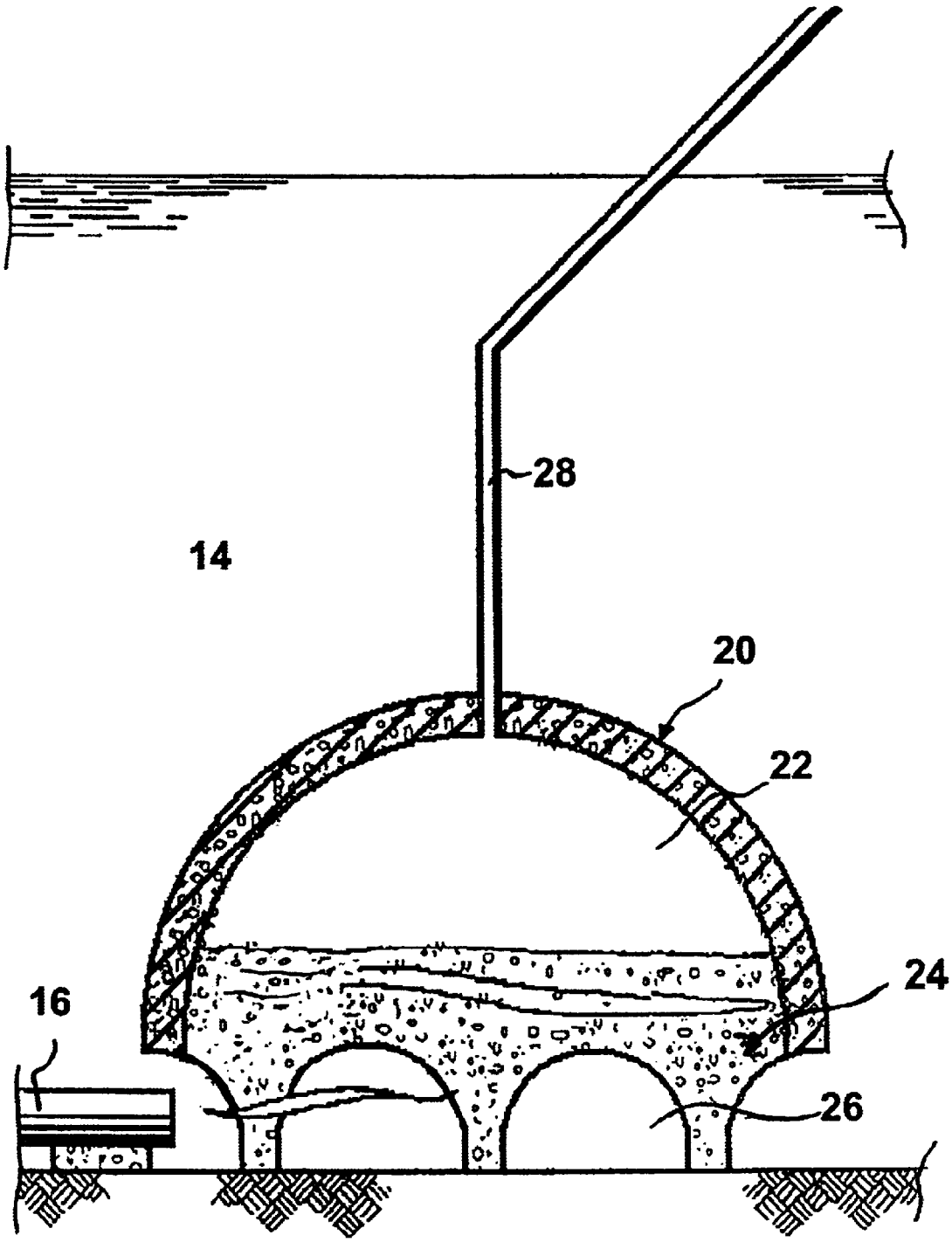
FIG. 2 is an enlarged sectional side view of the chamber of FIG. 1.

With additional reference to FIG. 2, chamber 20 in this specific embodiment, is generally dome shaped and has an upper portion 22 and a lower portion 24. Water from down-pipe 16 enters lower portion 24. Air carried by the water rises and is collected in upper portion 22. Water with the air extracted is exhausted through ports 26 formed around the edge of lower portion 24 of chamber 20. The up-pipe is formed by the body of water, ocean 14. A conduit 28 is coupled to upper portion 22 of chamber 20 to carry the compressed air to a power generating plant 30 positioned nearby. It will be understood that the compressed air can be used for a variety of purposes, and is not intended to be limited to power generation. For example, compressed air can also be used to power all types of pneumatic tools and equipment and as a heating and cooling source, etc. Furthermore, the compressed air can also be collected in containers for transport.

Figure 3:
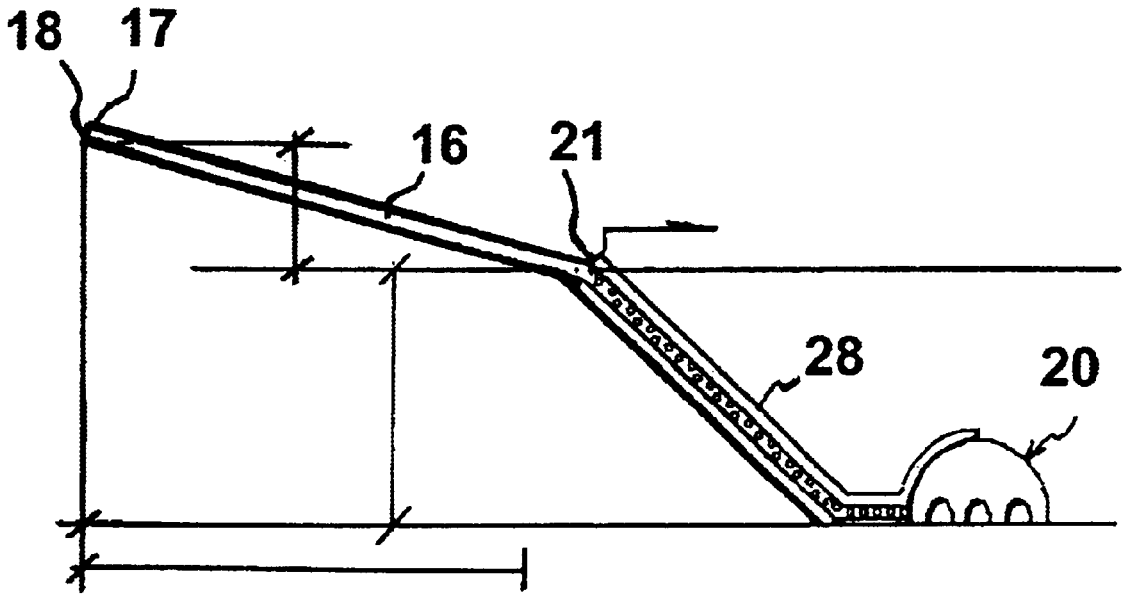
FIG. 3 is a simplified schematic view of the hydraulic air compressor system of FIG. 1.

Turning now to FIG. 3, a schematic representation of system 10 is illustrated. Down-pipe 16 extends from point 18, where water is inserted into intake head 17, to the bottom of ocean 14 terminating in chamber 20. At some point 21 along down-pipe 16, air is injected into the water to form a mix of air and water. Preferably a ratio of 28% air to water is employed. This number will vary depending on a great many factors as will be described in more detail. The hydraulic head is determined by height B from point 18 to the surface of ocean 14. The standing tube height, which determines the pressure of air within chamber 20 is depth D of ocean 14.

Many other details must be taken into account. For example, the air carried by the water in down-pipe 16 must reach chamber 20 before it escapes the water. Therefore, the water moving through down-pipe 16 must have sufficient velocity to overcome the tendency of the air bubbles to rise, thereby dragging the air downward. The velocity of the water must be a minimum of approximately one foot per second (1 ft/sec.). The velocity of the water depends on the height B of the applied hydraulic head, the cross section of pipe 16 and the slope or grade of down-pipe 16. A desired velocity is achieved by the correct positioning of point 18 and by maintaining down-pipe 16 at a sufficient grade, or, as preferred, providing a helical groove or rifling within down-pipe 16 to swirl the water and increase its velocity at a shallower grade. A primary purpose of swirling the water is to keep the bubbles toward the center of the fluid flow, thereby reducing the possibility of the bubbles collecting into large bubbles which could reduce efficiency at best and cause a destructive flow-back at worst.

Figure 5:
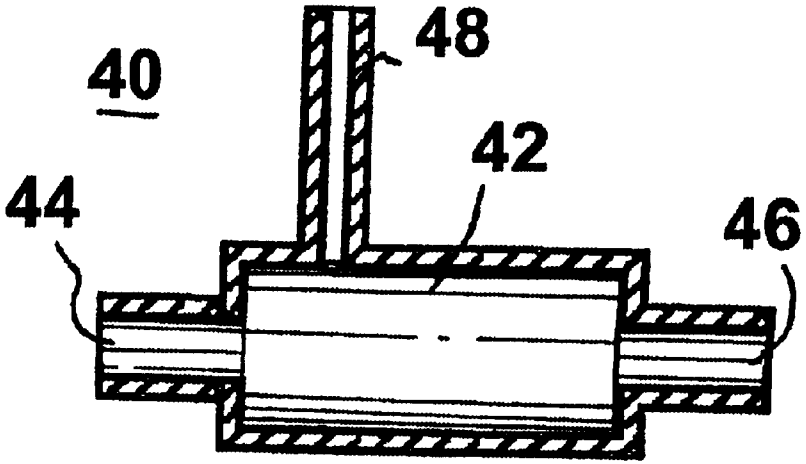
FIG. 5 is a sectional side view taken along line 5—5 of FIG. 4.
Figure 4:
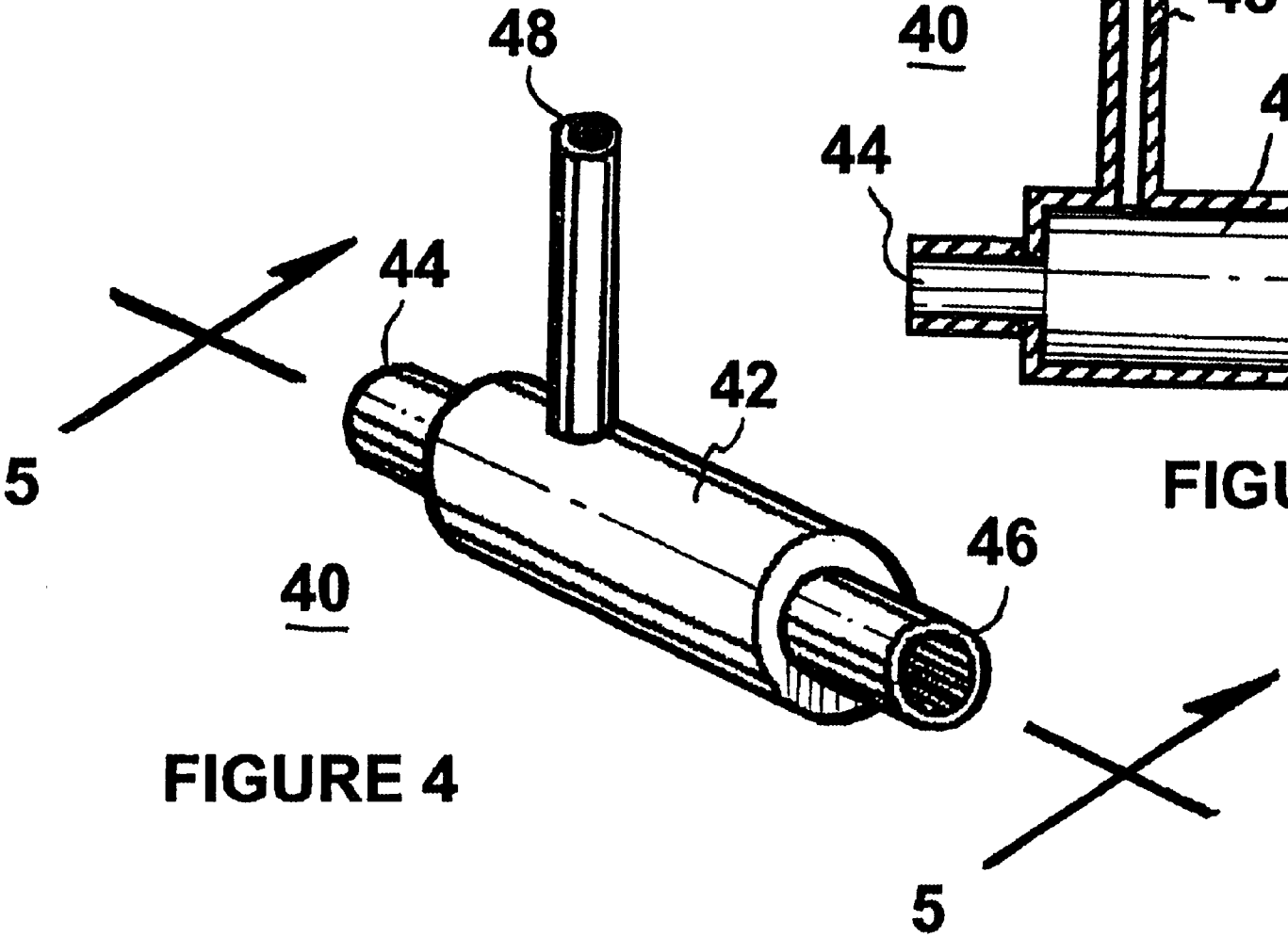
FIG. 4 is a perspective view of the venturi employed for injecting air into the down-pipe.

The pressure of the air collected in chamber 20 is approximately that of depth D of ocean 14, assuming air is injected at atmospheric pressure. The air is injected at point 21 somewhere along down-pipe 16 above ocean 14 by a venturi 40. Turning to FIGS. 4 and 5, venturi member 40 is illustrated. A section of down pipe 16 is widened into a chamber 42 having an input 44 and an output 46. An air conduit 48 is coupled to chamber 42. As water passes through down-pipe 16 and enters chamber 42, air is drawn through conduit 48 and is carried by the water employing the venturi effect. It will be understood that one or more venturi members 40 can be positioned at substantially any point along down-pipe 16 above ocean 14.

In this manner, the cost of hydraulic compression is greatly reduced since a standing pipe is replaced with a body of water, and the down-pipe is a simple pipe lowered from a water source to the bottom of the body of water. Also, locations where this device can be employed are extremely numerous and located on substantially any coastline.

Various changes and modifications to the embodiments herein chosen for purposes of illustration will readily occur to those skilled in the art. For example, while water and air have been disclosed as the primary components mixed to form compressed air, it should be understood that other fluid and gasses can be employed. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A gas compression system comprising:

a body of fluid having a surface and a lower level;

a down pipe having a first end and a second end, the first end positioned to receive a fluid from a source above the surface of the body of fluid and the second end positioned at the lower level of the body of fluid;

a gas inlet coupled to the down pipe above the surface of the body of fluid for mixing a gas to be compressed with the fluid from the source to form a mixture;

a chamber positioned at the lower level of the body of fluid and coupled to the second end of the down pipe for receiving the mixture and collecting a compressed gas therefrom; and a conduit coupled to the chamber for transferring the compressed gas therefrom.

2. A gas compression system as claimed in claim 1 wherein the conduit transports compressed gas to a power generating plant positioned proximate the body of fluid.

3. A gas compression system as claimed in claim 1 wherein the chamber includes an upper portion and a lower portion, the upper portion positioned to receive the compressed gas separating from the mixture as the mixture slows within the chamber allowing escape of compressed gas.

4. A gas compression system as claimed in claim 3 wherein the lower portion of the chamber includes a fluid communication with the body of fluid for allowing fluid separated from the mixture to enter the body of fluid.

5. A gas compression system as claimed in claim 3 wherein the gas inlet is a venturi.

6. A gas compression system as claimed in claim 5 wherein the venturi includes a chamber having a fluid inlet, a gas inlet and a mixture outlet.

7. A gas compression system as claimed in claim 1 wherein the fluid includes water.

8. A gas compression system as claimed in claim 7 wherein the fluid source is a river and the body of fluid is one of a lake, ocean, and sea.

9. A gas compress ion system as claimed in claim 7 wherein the first end is positioned above the surface of the body of fluid a distance sufficient to provide a velocity to the mixture such that gas mixed into the water is pulled into the chamber.

10. A gas compression system as claimed in claim 9 wherein the velocity of the mixture is approximately 1 foot per second.

11. A gas compression system as claimed in claim 9 wherein the down pipe includes an inner surface defining a helical groove, to swirl the water passing therethrough, thereby increasing the velocity thereof.

12. A gas compression system as claimed in claim 7 wherein the mixture includes a ratio of approximately 28% gas to water.

13. A method of compressing a gas comprising the step of:

providing a body of fluid having a surface and a lower level;

positioning a down pipe having a first end and a second end, the first end being positioned to receive a fluid from a source above the surface of the body of fluid and the second end being positioned at the lower level of the body of fluid;

mixing a gas to be compressed with the fluid from the source above the surface of the body of fluid to form a mixture;

positioning a chamber at the lower level of the body of fluid and coupling the chamber to the second end of the down pipe for receiving the mixture and collecting a compressed gas therefrom; and transferring the compressed gas from the chamber through a conduit.

14. A method as claimed in claim 13 wherein the step of positioning the chamber includes providing the chamber with an upper portion and a lower portion, the upper portion positioned to receive the compressed gas separating from the mixture as the mixture slows within the chamber allowing escape of compressed gas.

15. A method as claimed in claim 14 wherein the lower portion of the chamber includes a fluid communication with the body of fluid for allowing fluid separated from the mixture to enter the body of fluid.

16. A method as claimed in claim 13 wherein the step of mixing the gas with the fluid includes coupling a gas inlet to the down pipe above the surface.

17. A method as claimed in claim 16 wherein the step of coupling a gas inlet includes providing a venturi having a chamber with a fluid inlet, a gas inlet and a mixture outlet.

18. A method as claimed in claim 13 wherein the fluid source is a river and the body of fluid is one of a lake, ocean, and sea.

19. A method as claimed in claim 13 wherein the first end is positioned above the surface of the body a distance sufficient to provide a velocity to the mixture such that gas mixed into the fluid is pulled into the chamber.

20. A method as claimed in claim 19 wherein the velocity of the mixture is approximately 1 foot per second.

* * * * *